US010215460B2

(12) United States Patent
Wu

(10) Patent No.: US 10,215,460 B2
(45) **Date of Patent: *Feb. 26, 2019**

(54) VARIABLE EXPANSION DEVICE WITH THERMAL CHOKING FOR A REFRIGERATION SYSTEM

(71) Applicant: WHIRLPOOL CORPORATION, Benton Harbor, MI (US)

(72) Inventor: Guolian Wu, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/251,005

(22) Filed: Aug. 30, 2016

(65) Prior Publication Data

US 2016/0370041 A1 Dec. 22, 2016

Related U.S. Application Data

(63) Continuation of application No. 14/017,805, filed on Sep. 4, 2013, now Pat. No. 9,441,866.

(51) Int. Cl.
*F25B 41/06* (2006.01)
*F25B 41/00* (2006.01)

(52) U.S. Cl.
CPC ..... *F25B 41/067* (2013.01); *F25B 41/00* (2013.01); *F25B 2341/066* (2013.01);
(Continued)

(58) Field of Classification Search
CPC ..... F25D 11/00; F25D 11/02; F25D 11/022; F25B 40/00–40/06; F25B 41/067
See application file for complete search history.

(56) References Cited

U.S. PATENT DOCUMENTS 3,003,333 A 10/1961 Lysen
4,147,037 A * 4/1979 Gelbard ..... B23P 15/26 138/140

(Continued)

FOREIGN PATENT DOCUMENTS

CN 102767926 A 11/2012
EP 541157 A1 5/1993

(Continued)

*Primary Examiner* — Jianying Atkisson
*Assistant Examiner* — Antonio R Febles
(74) *Attorney, Agent, or Firm* — Price Heneveld LLP

(57) ABSTRACT

A refrigeration system including a suction line heat exchanger having a first conduit including a refrigerant liquid which flows inside of the first conduit from the condenser to the evaporator. Also the refrigeration system includes a second conduit in thermal communication with the first conduit and includes a refrigerant fluid, typically a vapor, which flows inside of the second conduit in an opposite direction of flow from the first conduit from the evaporator to the compressor. Additionally, at least one heating device is in thermal communication with at least one of the first conduit and second conduit and is configured to communicate with a refrigeration control system to apply heat along a portion of both the first conduit and the second conduit adjacent to the heating device thereby regulating the flow rate of the refrigerant liquid in the first conduit and the second conduit.

20 Claims, 5 Drawing Sheets

(52) U.S. Cl.
CPC ..... *F25B 2400/01* (2013.01); *F25B 2400/052* (2013.01); *F25B 2400/054* (2013.01)

(56) References Cited

U.S. PATENT DOCUMENTS

| | | | |
|---|---|---|---|
| 5,156,016 | A | 10/1992 | Day |
| 5,406,805 | A | 4/1995 | Radermacher et al. |
| 6,351,950 | B1 | 3/2002 | Duncan |
| 6,453,476 | B1 | 9/2002 | Moore, III |
| 7,363,766 | B2 | 4/2008 | Eisenhour |
| 7,721,569 | B2 | 5/2010 | Manole |
| 2006/0266077 | A1 | 11/2006 | Wiest |
| 2010/0293987 | A1 | 11/2010 | Horst et al. |
| 2012/0111037 | A1 | 5/2012 | Campbell et al. |

FOREIGN PATENT DOCUMENTS

| | | | |
|---|---|---|---|
| EP | 624763 | A1 | 11/1994 |
| GB | 1480572 | A | 7/1977 |
| JP | 2000033816 | A | 2/2000 |
| JP | 3247963 | B2 | 1/2002 |

* cited by examiner

VARIABLE EXPANSION DEVICE WITH THERMAL CHOKING FOR A REFRIGERATION SYSTEM

CROSS-REFERENCE TO THE RELATED APPLICATIONS

This application is a continuation of U.S. patent application Ser. No. 14/017,805, filed Sep. 4, 2013, entitled "A VARIABLE EXPANSION DEVICE WITH THERMAL CHOKING FOR A REFRIGERATION SYSTEM" now U.S. Pat. No. 9,441,866. The aforementioned related application is hereby incorporated by reference in its entirety.

FIELD OF THE INVENTION

The present invention generally relates to an appliance refrigeration cooling system including a suction line heat exchanger.

SUMMARY OF THE INVENTION

An aspect of the present invention is generally directed toward a refrigeration system having an evaporator. The refrigeration system also includes a condenser and a compressor. Moreover, the refrigeration system includes a suction line heat exchanger having a first conduit including a refrigerant liquid which flows inside of the first conduit from the condenser to the evaporator. Also, the refrigeration system includes a second conduit in thermal communication with the first conduit and includes a refrigerant fluid (typically vapor) which flows inside of the second conduit in an opposite direction of flow from the first conduit from the evaporator to the compressor. The refrigerant liquid also has a flow rate. Additionally, at least one heating device is in thermal communication with at least the first conduit and/or second conduit and is configured to communicate with a refrigeration control system to apply heat along a portion of one or, more typically, both the first conduit and the second conduit adjacent to the heating device thereby regulating the flow rate of the refrigerant liquid in the first conduit and the second conduit.

Another aspect of the present invention is generally directed to an appliance that includes an evaporator, a condenser, and a compressor. The appliance also includes a suction line heat exchanger having a first conduit which includes a refrigerant liquid that flows at a flow rate inside of the first conduit from the condenser to the evaporator. The suction line heat exchanger also has a second conduit in abutting contact with the first conduit and includes a refrigerant fluid (typically vapor) which flows at a flow rate inside of the second conduit from the evaporator to the compressor. The refrigerant fluid (typically vapor) in the second conduit flows opposite the fluid from the direction of refrigerant liquid flow inside of the first conduit. The appliance also includes at least one concentrated heating device in abutting contact with the first conduit and the second conduit and configured to be in communication with a refrigeration control system in order to apply heat along at least a portion or the entire length of both the first conduit and the second conduit in order to regulate the flow rate of the refrigerant liquid by converting a portion of the refrigerant liquid to a vapor.

Yet another aspect of the present invention is generally directed towards a method which includes first moving a refrigerant liquid through a suction line heat exchanger having a first conduit and a second conduit in abutting contact. Next, the refrigerant liquid flows through the first conduit from a condenser to an evaporator at a first flow rate. The refrigerant fluid (typically vapor) also flows through the second conduit from the evaporator to a compressor at the flow rate, which may be the same, but is usually not the same as the first flow rate. The refrigerant fluid (typically vapor) through the second conduit flows in an opposite direction of the refrigerant fluid flowing through the first conduit. Finally, a portion of the refrigerant liquid is heated using at least one heating device disposed in thermal communication with at least one of the first conduit and the second conduit and the heating device communicates with a refrigeration control system in order to apply heat along the portion of both the first conduit and the second conduit adjacent to the heating device thereby heating a portion of the refrigerant liquid to a vapor in order to regulate the flow rate of the refrigerant liquid and thereby regulate the cooling capacity of the system. (Benefits of the present invention can be achieved by applying heat to the refrigerant liquid that flows inside the first conduit). Heat or heat sufficient to vaporize refrigerant liquid does not need to be applied to the second conduit.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessarily to scale, but relative special relationships are shown and the drawings may be to scale especially where indicated as such, in the description or as would be apparent to those skilled in the art. Certain features of the invention may be exaggerated in scale or shown in schematic form in the interest of clarity and conciseness.

DETAILED DESCRIPTION

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

The present invention is generally directed to appliance systems typically refrigerator/freezer combinations and methods for increasing the efficiency of the appliance 10. The appliance systems may be bottom mount freezer systems, top mount freezer systems, side-by-side refrigerator and freezer systems, or French door style bottom mount freezer systems that may or may not employ a third compartment, typically a drawer that may operate as a refrigerator drawer or a freezer drawer.

Figure 1:
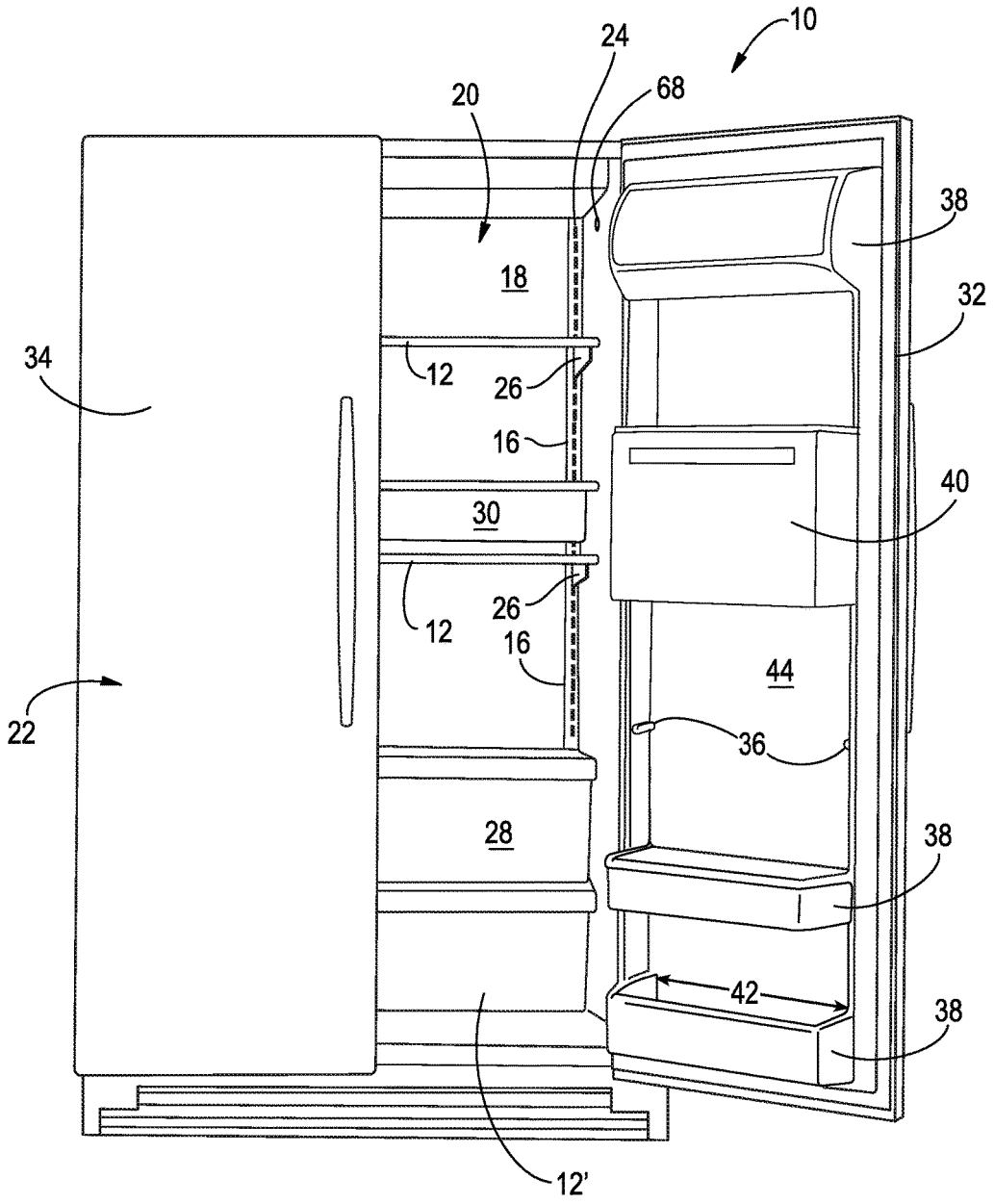
FIG. 1 is a perspective view of a side-by-side refrigerator/freezer incorporating the refrigeration system of the present invention.

The appliance 10, which is typically a refrigerator is adapted to receive and/or be capable of receiving a variety of shelves 12 and modules at different positions defined by, in the embodiment shown in FIG. 1, a plurality of horizontally spaced vertical rails 16 extending from a rear wall 18 of the refrigerator cabinet section(s) 20 and freezer cabinet section(s) 22 or other compartment(s). In the embodiment shown, the supports are in the form of vertically extending rails 16 with a plurality of vertically spaced slots 24 for receiving mounting tabs on shelf supports 26 and similar tabs on modules, such as a module, a crisper 28, a shelf 12, or drawer 30. These components are attached in cantilever fashion to the cabinet sections at selected incrementally located positions. The inside edges of the refrigerator compartment door 32 and the freezer compartment door 34 also include vertically spaced shelf supports 36 for positioning and engaging a bin 38 and/or door module 40 along the liner 44 of the refrigerator compartment door 32 and the freezer compartment door 34. These compartments are typically positioned within the pocket 42 of the refrigerator compartment door 32 and the freezer compartment door 34 defined by the liner 44, the shelves 12, module, bin 38, and the like, can be located at a variety of selected locations within the refrigerator cabinet sections 20 and the freezer cabinet section 22 and refrigerator compartment door 32 and the freezer compartment door 34 to allow the consumer to select different locations for convenience of use.

Figure 5:
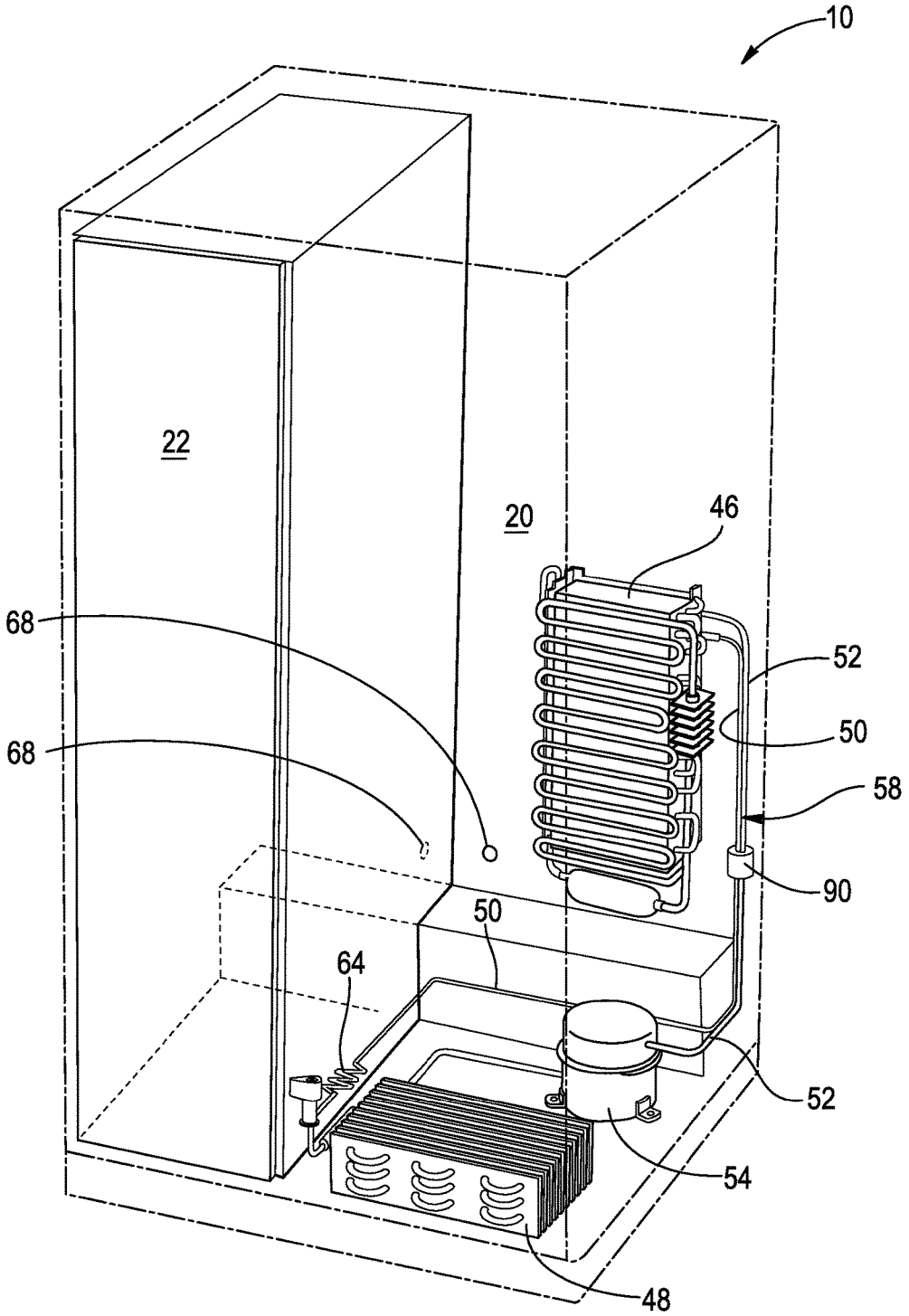
FIG. 5 is an interior schematic view of yet another embodiment of the present invention.
Figure 6:
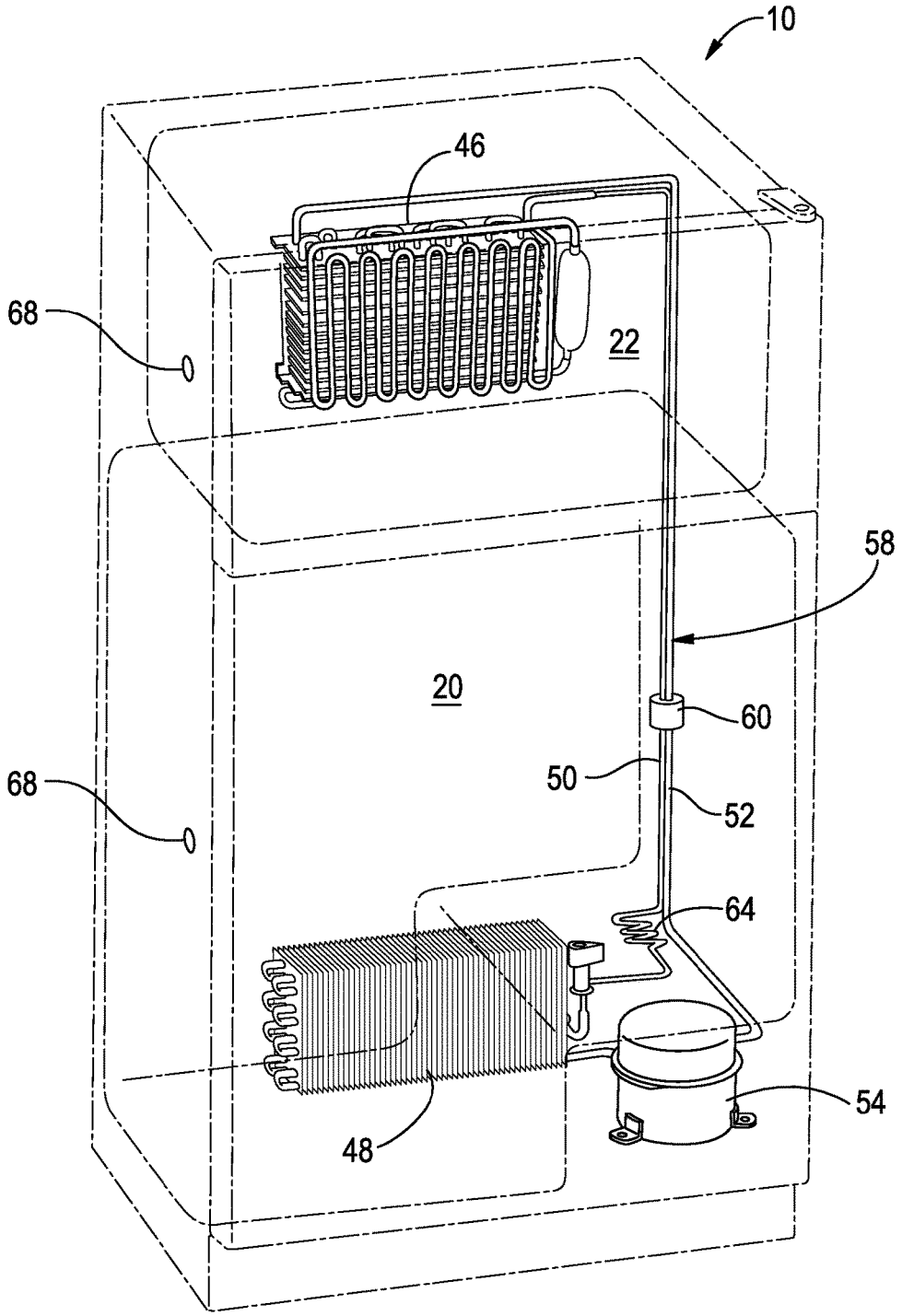
FIG. 6 is an interior schematic view of another embodiment of the present invention.
Figure 7:
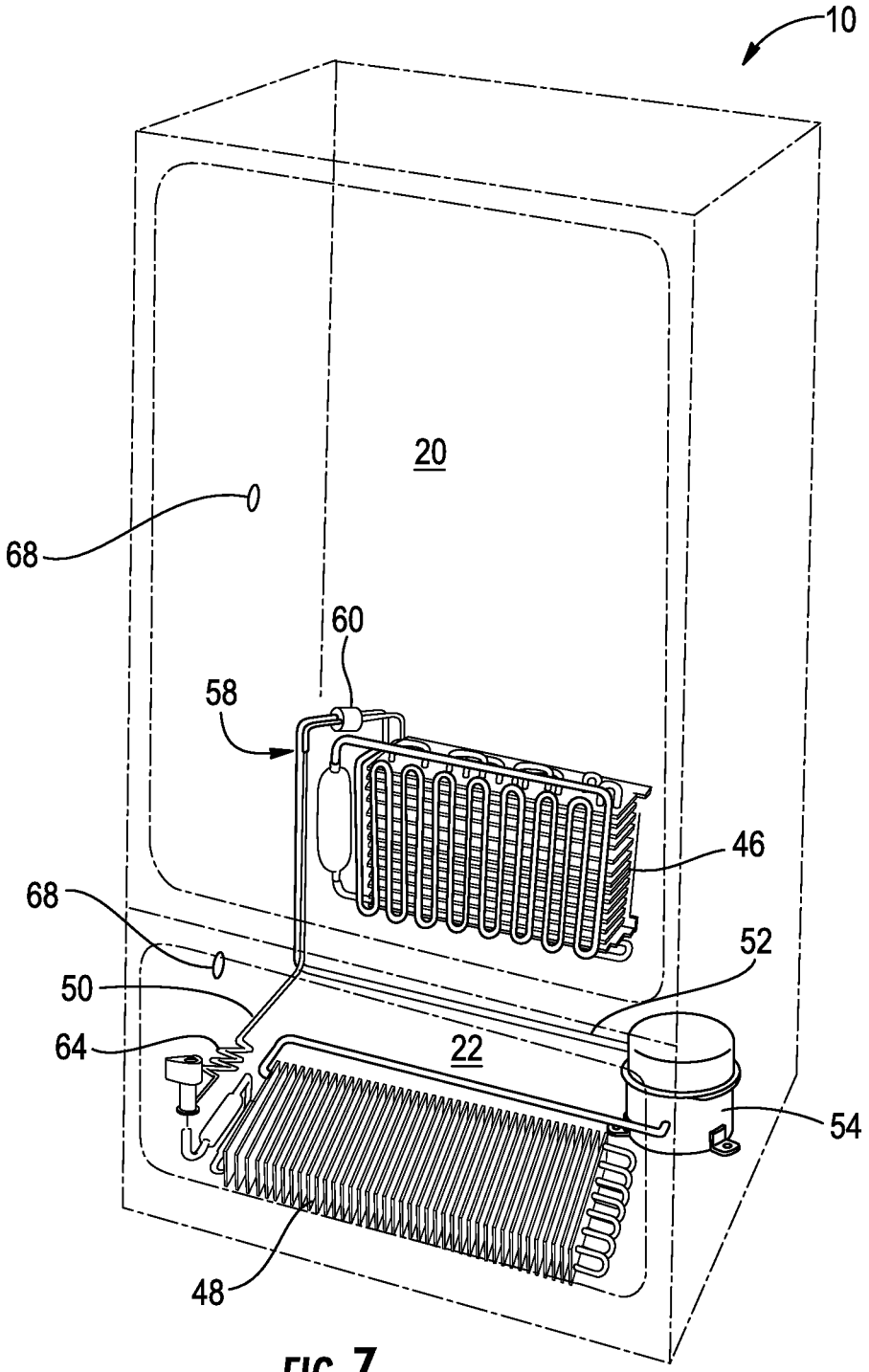
FIG. 7 is an interior schematic view of one embodiment of the present invention.

As shown in various figures including FIGS. 5-7, the appliance 10 may be of any known configuration for a refrigeration appliance typically employed. Such a configuration includes a side-by-side (FIGS. 1 and 5), top mount freezer (FIG. 6), bottom mount freezer (FIG. 7), or French door bottom mount freezer (not shown). Generally speaking each of the embodiments employ at least two compartments, a first compartment, which is typically a fresh food compartment or a compartment operating at a higher operating temperature than a second compartment, which is typically a freezer compartment. Also, each of the first compartment and second compartment may have an individual evaporator 46 associated with the compartments or one evaporator may serve both compartments. For example, one evaporator may be deployed or disposed in the refrigerator cabinet section 20 while the other evaporator is disposed in the freezer cabinet section 22. A third evaporator may be used and associated with an optional third drawer sometimes present. A fan or fans, which are optional, are generally positioned proximate the evaporator to facilitate cooling of the compartment/heat transfer. Similarly, a fan or fans may be used in conjunction with the condenser 48. Typically, fans improve heat transfer effectiveness, but are not necessary.

Thermal storage material may also be used to further enhance efficiencies of the appliance 10. Thermal storage material, which can include phase changing material or high heat capacity material such as metal solids, can be operably connected to the evaporator 46. The thermal storage material may be in thermal contact or in engagement with the evaporator 46, in thermal contact or in engagement with the first fluid conduit 50 and the second fluid conduit 52, or in thermal contact or engagement with both the evaporator 46 and the first fluid conduit 50 and second fluid conduit 52. The use of the thermal storage material helps prevent relatively short down time of the compressor 54. Additionally, the appliance 10 may also include vacuum insulated panels insulating the appliance 10 to further improve the efficiency of this system.

The compressor 54 may be a standard reciprocating or rotary compressor, a variable capacity compressor, including, but not limited to, a linear compressor, which is an orientation flexible compressor (i.e., it operates in any orientation, not just a standard upright position, but also a vertical position and an inverted position, for example). When a linear compressor, which can be an oilless linear compressor, is utilized, the linear compressor typically has a variable capacity modulation, which is typically larger than a 3:1 modulation capacity. The modulation low end is limited by lubrication and modulation scheme.

Some of the modules in the appliance 10 may be powered modules receiving power from the appliance 10 (or a plurality of utilities). For example, the crisper 28 may be a powered crisper or a quick thaw or chill module and may require utilities, such as cooled or heated fluids or electrical operating power and receive these utilities from the appliance 10. The door modules 40, also may utilize one or more utilities. For example, these door modules 40 may be a water dispenser, a vacuum bag sealer, or other accessory conveniently accessible from either the outside of the door or upon opening the door and likewise may receive operating utilities from conduits, such as disclosed in U.S. Pat. No. 6,453,476, issued on Jun. 4, 2013, entitled Refrigerator Module Mounting System; and U.S. patent application Ser. No. 12/469,968, filed May 21, 2009, entitled Multiple Utility Ribbon Cable. The disclosures of this patent and patent application are incorporated herein by reference in their entirety. A module may also provide for quick cooling of beverages, quick freezing/chilling of other food stuffs or even making of ice, ice pieces or cubes, or frozen products.

The refrigeration system 56 of the present invention typically uses a specifically configured suction line heat exchanger 58 that includes heating device 60 to regulate and dynamically adjust the overall cooling capacity of the refrigerant system 56. The refrigeration system 56 may employ multiple heating device 60 disposed along, typically in physical contact or at least in thermal communication with the first fluid conduit 50 and/or the second fluid conduit 52. However, typically, the suction line heat exchanger 58 uses only one heating device 60. The heating device 60 allows a portion, typically a small portion, of refrigerant fluid 62, in the suction line heat exchanger 58 to be heated into a vapor in order to regulate the flow rate of the refrigerant fluid 62. Generally speaking, the appliance 10 gains efficiency by employing the heating device 60, which in a regulating fashion in conjunction with a control system 100 transforms a portion of the refrigerant fluid 62 inside of the suction line heat exchanger 58 into a vapor. The resulting vapor bubbles will choke the flow of the refrigerant fluid 62 in the first fluid conduit 50 and the second fluid conduit 52 and change the flow rate of the refrigerant fluid 62 because the mass flow of refrigerant fluid 62 is a function of geometrical parameters of the conduits, evaporating and condensing pressures, sub-cooling degree, heat flex intensity, and/or duration.

The suction line heat exchanger 58 includes a section of a plurality of refrigerant fluid conduits, at least a first fluid conduit 50, and a second fluid conduit 52 in thermal contact with one another. The suction line heat exchanger 58 at least includes a portion of both conduits and is configured and constructed to place the first fluid conduit 50 and second fluid conduit 52 in thermal communication with one another, typically in physical contact with one another for a length of both the first fluid conduit 50 and the second fluid conduit 52. The first fluid conduit 50 may provide refrigerant flow from the condenser 48 to the evaporator 46 while the second fluid conduit 52 provides refrigerant flow from the evaporator 46 to the compressor 54.

The refrigerant fluid 62 flow within the interior of the first fluid conduit 50 and the second fluid conduit 52 is in an opposite direction of one another at a point along the suction line heat exchanger 58. Typically, the fluid in the conduits flow in opposing directions for at least a length of the suction line heat exchanger 58 when the first fluid conduit 50 and the second fluid conduit 52 are physically engaged for a length of fluid travel distance. The flow rate of the refrigerant inside of the first fluid conduit 50 and flow rate inside of the second fluid conduit 52 are typically the same rate or approximately the same rate; however, these rates may be different.

The first fluid conduit 50 and the second fluid conduit 52 are typically comprised of a material having a high heat transfer coefficient, typically steel but may also be a highly thermally conductive plastic polymer, glass, or other material as known by one of ordinary skill in the art. The first fluid conduit 50 and the second fluid conduit 52 are in thermal communication with each other, and as discussed are typically in abutting contact with each other for at least a portion of their lengths. Most typically, the first fluid conduit 50 and the second fluid conduit 52 join in abutting contact beginning as close to the evaporator 46 as possible, and remain in abutting contact until the first fluid conduit 50 and the second fluid conduit 52 are as close as possible to the condenser 48 and the compressor 54.

Figure 2:
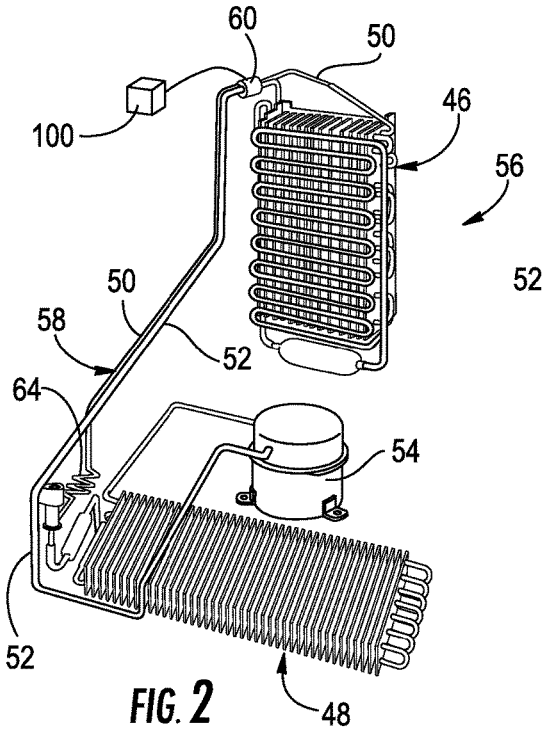
FIG. 2 is a schematic view of the refrigeration system that may be utilized according to an aspect of the present invention.
Figure 3A:
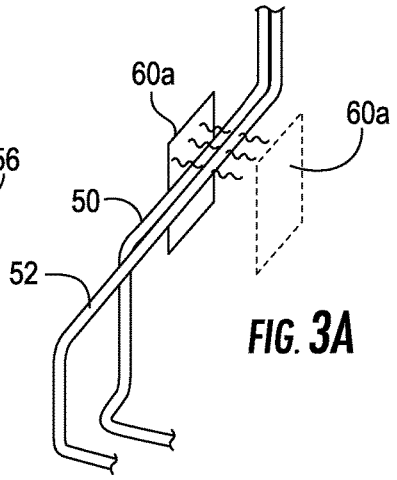
FIG. 3A is a schematic view of a portion of the refrigeration system that may be utilized according to another aspect of the present invention.
Figure 3:
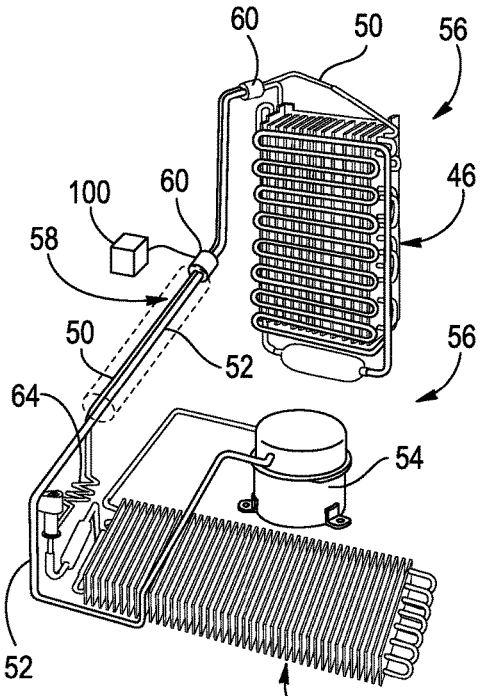
FIG. 3 is a schematic view of the refrigeration system that may be utilized according to another aspect of the present invention.
Figure 4:
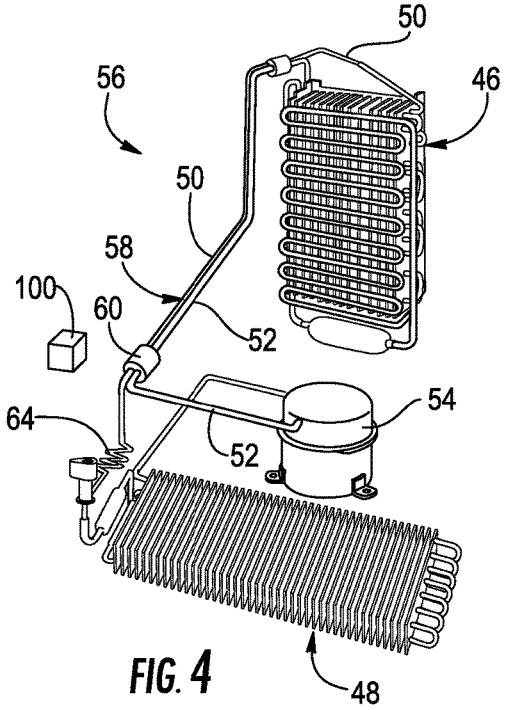
FIG. 4 is a schematic view of the refrigeration system that may be utilized according to yet another aspect of the present invention.

Referring now to the embodiments shown in FIGS. 2-4, the suction line heat exchanger 58 also includes the heating device 60. The heating device 60 is typically disposed in thermal communication with both the first fluid conduit 50 and the second fluid conduit 52. The heating device 60 may be a concentrated heating device, heating coils, or any other heating device as known by one of ordinary skill in the art. The heating device 60 may be disposed at any point along the first fluid conduit 50 and the second fluid conduit 52 where the first fluid conduit 50 and the second fluid conduit 52 are in abutting contact with each other including substantially centrally located (FIG. 3) proximate the evaporator 46 (FIG. 2) or proximate the condenser 48 and compressor 54 (FIG. 4). The heating device 60 may be disposed proximate the evaporator 46 but at a distance where any heat from the heater is not sufficiently felt by the evaporator 46 itself such that the heater in any way effects the functioning of the evaporator 46.

The refrigeration system 56 also typically includes a control system 100 which regulates the heat flux and/or duration of the heating device 60 to control the flow rate of the refrigerant fluid 62 and thereby the cooling capacity of the appliance 10. The control system 100 increases heat flux and/or duration of the heating device 60 when the superheat at the evaporator exit is less than the desired value, again, typically. Conversely, the control system 100 decreases heat flux and/or duration of the heat device when the superheat at the evaporator exit is greater than the desired value as measured by at least one thermistor communicatively connected to the control system typically by wires. Superheat is defined as the actual temperature of refrigerant minus the saturation temperature.

Referring again to the embodiments shown in FIGS. 2-7, based on cooling demand, a control system 100 in the refrigeration system 56 regulates the heat flux intensity and/or duration of time the heating device 60 is active and/or the heat intensity temperature in order to control the flow rate of the refrigerant fluid 62. The control system 100 and suction line heat exchanger 58 allow better energy efficiency for a wide range of operating conditions because the control system 100 can regulate the throttling characteristics in order to obtain desired sub-cooling for a given condition within the appliance 10. Moreover, the control system 100 and the suction line heat exchanger 58 allow for better temperature recovering and pull down because the control system 100 can reduce throttling during temperature recovery and pull down allowing maximum cooling capacity when called for by the control system of the appliance 10 when needed. The thermal choking is controlled by the control system 100 based on the degree of superheat at the exit from the evaporator 46. Actually, because the heating device 60 applies heat to both the first fluid conduit 50 and the second fluid conduit 52, the heating, in addition to regulating efficiency of the system also prevents liquid refrigerant that may not have been fully evaporated in the evaporator from returning to the compressor 54 in liquid form, which might damage the compressor 54.

In operation, refrigerant fluid 62 is moved through the suction line heat exchanger 58 having the first fluid conduit 50 and the second fluid conduit 52. As discussed, the first fluid conduit 50 and the second fluid conduit 52 are generally in abutting contact. The refrigerant fluid 62 is flowed through the first fluid conduit 50 from the condenser 48 to the evaporator 46 at a given flow rate while the refrigerant fluid 62 is also moved through the second fluid conduit 52, in the opposite direction of the flow rate in the first fluid conduit 50, from the evaporator 46 to the compressor 54, usually at the same flow rate or about the same flow rate as the refrigerant fluid 62 in the first fluid conduit 50. In order to control the flow rates of refrigerant fluid 62, heating device 60 is disposed in thermal communication with the first fluid conduit 50 and the second fluid conduit 52 and is configured to communicate with the control system 100, which provides an on/off signal to the heating device 60 to regulate cooling capacity based upon demand for cooling sensed from temperate sensor(s) including sensors that measure ambient temperature and temperature sensors 68 within the refrigerator cabinet section 20, the freezer cabinet section 22, or both. The heating device 60 supplies heat along a portion of both the first fluid conduit 50 and the second fluid conduit 52. Once the refrigerant fluid 62 inside the first fluid conduit 50 and the second fluid conduit 52 reaches its boiling point, a portion of the refrigerant fluid 62 turns into a vapor, which produces bubbles inside of the first fluid conduit 50 and the second fluid conduit 52. The portion of refrigerant fluid 62 which turns to vapor is typically a small amount and most typically not more than approximately 2-3% of the total refrigerant fluid 62. The bubbles choke the first fluid conduit 50 and the second fluid conduit 52 which changes the flow rate of refrigerant fluid 62 in both the first fluid conduit 50 and the second fluid conduit 52. It is contemplated that the first fluid conduit 50 and the second fluid conduit 52 may be heated by the heating device 60 to different temperatures thereby resulting in the refrigerant fluid 62 inside of only one of the first fluid conduit 50 and the second fluid conduit 52 reaching its boiling point such that the flow rate in only one of the first fluid conduit 50 and the second fluid conduit 52 is affected.

In typical refrigeration systems used in domestic refrigerators, a capillary tube 64 is used which has given throttling characteristics and usually cannot control its flow rate. Typically refrigeration systems lose efficiency when operating off the design condition. Specifically, the capillary tube 64 or the expansion device is necessary to allow the refrigeration system 56 to operate efficiently and effectively for a wide range of operating conditions. The present invention allows the refrigeration system 56 to control the flow rate of refrigerant fluid 62 by utilizing the control system 100 which operates the concentrated heating device 60 which simultaneously heats a portion of refrigerant fluid 62 inside the first fluid conduit 50 and the second fluid conduit 52 into a vapor which regulates the flow rate of the refrigerant fluid 62. The present invention allows better energy efficiency as the refrigeration system 56 can regulate the flow rate of refrigerant fluid 62 and thus throttling characteristics in order to obtain the desired sub-cooling. Moreover, as discussed above, the system 50 results in better temperature recovery and pull down because the system 50 can reduce throttling during temperature recovery and pull down.

Typically, the suction line heat exchanger 58 also includes at least a portion of one or more expansion devices such as a capillary tube 64 or capillary tubes. Generally speaking, for manufacturing reasons, only a part (from about 70% to 90%) of capillary tube and suction line are joined together. The suction line heat exchanger system 58 may also optionally employ one or more check valves that prevent back flow of refrigerant fluid 62 in the overall system in the first or second conduit. Check valves are typically employed when a multiple evaporator coolant system is employed operating in a non-simultaneous manner with different evaporating pressures. The check valve or valves are typically incorporated into the second fluid conduit 52 line.

Those skilled in the art will recognize, or be able to ascertain using no more than routine experimentation, many equivalents to the specific embodiments of the invention described herein. Such equivalents are intended to be encompassed by the following claims.

The invention claimed is:

1. A system for regulating a cooling capacity of a refrigeration system, comprising:

a suction line heat exchanger comprising:

a first conduit and a second conduit disposed next to each other and in thermal contact with each other along at least a portion of their lengths; and a refrigerant fluid flowing through the first and second conduits; and at least one heating device thermally coupled to each of the first and second conduits and located at one or more points along the suction line heat exchanger where the first and second conduits are abutting each other and in thermal contact, wherein the at least one heating device is configured to apply heat to each of the first and second conduits, and wherein the heat applied to at least one of the first and second conduits is sufficient to vaporize a portion of the refrigerant fluid to regulate a flow rate of the refrigerant fluid.

2. The system of claim 1, wherein the refrigerant fluid flowing through the first conduit is provided from a condenser to an evaporator, and wherein the refrigerant flowing through the second conduit is provided from the evaporator to a compressor.

3. The system of claim 1, wherein the first and second conduits are in abutting contact with one another for at least a portion of their lengths, and wherein the at least one heating device is in physical contact with at least one of the first and second conduits.

4. The system of claim 1, wherein the at least one heating device is located at a point along the suction line heat exchanger where the refrigerant fluid flows through the first and second conduits in opposite directions.

5. The system of claim 1, further comprising a control system operably coupled to the at least one heating device for determining at least one of a heat flux and a duration of the at least one heating device.

6. The system of claim 1, wherein the at least one heating device applies heat to the suction line heat exchanger such that the flow rate of the refrigerant fluid in the first and second conduits is the same or approximately the same.

7. The system of claim 1, wherein the at least one heating device applies heat to the suction line heat exchanger such that the flow rate of the refrigerant inside only one of the first conduit and the second conduit is affected.

8. A system for regulating a cooling capacity of a refrigeration system, comprising:

a suction line heat exchanger comprising:

a first conduit configured to provide refrigerant fluid from a condenser to an evaporator and a second conduit configured to provide refrigerant fluid from the evaporator to the condenser, the first and second conduits disposed next to each other and in abutting contact with each other along at least a portion of their lengths; and at least one heating device located at one or more points along the suction line heat exchanger where the first and second conduits are abutting each other and in thermal contact, wherein the at least one heating device is thermally coupled to both of the first and second conduits and is configured to apply heat to the first and second conduits, and wherein the heat applied to the first and second conduits is sufficient to vaporize a portion of the refrigerant fluid to regulate a flow rate of the refrigerant fluid.

9. The system of claim 8, wherein the at least one heating device is located at a central location of the suction line heat exchanger.

10. The system of claim 9, wherein the heating device is configured to heat the first conduit to a first temperature and the second conduit to a second temperature, and wherein only the heat applied to the first conduit is sufficient to vaporize a portion of the refrigerant fluid.

11. The system of claim 8, wherein the at least one heating device is located proximate the evaporator.

12. The system of claim 8, wherein the at least one heating device is located proximate at least one of the condenser and the compressor.

13. The system of claim 8, wherein the at least one heating device is located at a point along the suction line heat exchanger where the refrigerant fluid flows through the first and second conduits in opposite directions.

14. The system of claim 8, wherein the at least one heating device is in physical contact with both of the first and second conduits.

15. A method of regulating a cooling capacity of a refrigeration system, comprising the steps of:

providing a suction line heat exchanger having a first conduit configured to provide refrigerant fluid from a condenser to an evaporator and a second conduit configured to provide refrigerant fluid from the evaporator to the condenser, the first and second conduits being disposed next to each other and in thermal contact with each other along at least a portion of their lengths;

thermally coupling at least one heating device to each of the first and second conduits and locating the at least one heating device at one or more points along the suction line heat exchanger where the first and second conduits are abutting each other and in thermal contact; and operating the at least one heating device to apply heat to the first and second conduits, wherein the heat applied to the first and second conduits is sufficient to vaporize a portion of the refrigerant fluid to regulate a flow rate of the refrigerant fluid.

16. The method of claim 15, wherein the at least one heating device is located at a point along the suction line heat exchanger where the refrigerant fluid flows through the first and second conduits in opposite directions.

17. The method of claim 15, further comprising the step of controlling at least one of a heat flux and a duration of the at least one heating device based on commands provided to the at least one heating device from a control system of the refrigeration system.

18. The method of claim 15, wherein the at least one heating device is in physical contact with at least one of the first and second conduits.

19. The method of claim 15, wherein the at least one heating device applies heat simultaneously to the first and second conduits.

20. The method of claim 15, wherein the heating device is configured to heat the first conduit to a first temperature and the second conduit to a second temperature, and wherein only the heat applied to the first conduit is sufficient to vaporize a portion of the refrigerant fluid.

* * * * *